US005655225A

United States Patent [19]

Mathers

[11] Patent Number: 5,655,225

[45] Date of Patent: Aug. 12, 1997

[54] PROTECTIVE HEADGEAR ATTACHMENT FOR BASEBALL STYLE CAPS

[75] Inventor: D. Stephen Mathers, Plymouth, Minn.

[73] Assignee: Signwear Inc., Plymouth, Minn.

[21] Appl. No.: 444,753

[22] Filed: May 19, 1995

[51] Int. Cl.[6] ..... A42B 1/06

[52] U.S. Cl. ..... 2/172; 2/181.4; 2/209.13; 24/30.5 S

[58] Field of Search ..... 2/10, 172, 175.1, 2/181, 181.2, 181.4, 181.6, 181.8, 182.8, 195.1, 206, 207, 209.13; 24/30.5 S, 198; 40/329, 360, 641

[56] References Cited

U.S. PATENT DOCUMENTS

| | | | |
|---|---|---|---|
| 2,030,996 | 2/1936 | Lustig | 24/30.5 S |
| 2,067,231 | 1/1937 | Clark | 40/329 |
| 4,570,304 | 2/1986 | Montreuil et al. | 24/30.5 S |
| 4,646,394 | 3/1987 | Krauss | 24/30.5 S |
| 5,161,259 | 11/1992 | Shorts | 2/172 |
| 5,516,114 | 5/1996 | Michlin et al. | 24/30.5 S |
| 5,519,892 | 5/1996 | Pizzacar | 2/181 |

*Primary Examiner*—Diana Biefeld
*Attorney, Agent, or Firm*—Vidas, Arrett & Steinkraus, P.A.

[57] ABSTRACT

The present invention is directed to a detachable protective headgear attachment for engagement to a hat having an upturned inner band. The headgear attachment comprises substantially rectangular engagement clips having upper and lower portions, and upper and lower tabs, wherein the upper tab extends from the upper portion and the lower tab extends from the lower portion, the upper and lower tabs being opposingly situated. The headgear attachment further comprises a substantially rectangular flexible protective shield comprising an upper and lower portion, wherein the engagement clips are attached to the upper portion of the flexible shield, and wherein the flexible shield depends from the engagement clips. The headgear attachment is fastened to a baseball style hat by engaging the engagement clips to the upturned inner band at opposite sides of the hat, the upper tab being disposed between the upturned inner band and the interior crown portion and the lower tab being substantially flush with the exterior crown portion.

24 Claims, 2 Drawing Sheets

PROTECTIVE HEADGEAR ATTACHMENT FOR BASEBALL STYLE CAPS

FIELD OF THE INVENTION

This invention relates to an improved protective headgear attachment for use with an expandable or fitted "baseball" style hat having an upturned inner band. More particularly, a protective headgear attachment with an improved attachment means used to attach and detach the protective headgear attachment to the upturned inner band of a hat.

BACKGROUND OF THE INVENTION

Hat sunguards are well known to be helpful in protecting wearers against sunburn and wind. Baseball hats provide limited protection, leaving the ears and the back of the neck exposed to the sun. Shielding of these areas has been accomplished by affixing a flap type sunguard onto the back portion of the hat. These sunguards are usually made of light weight material and are either permanently attached or detachably attached.

U.S. Pat. No. 5,355,535 discloses a hat sunguard for use with a baseball style cap having an upturned inner band. The sunguard comprises a substantially rectangular flap having a pair of pockets enclosing rigid tabs positioned on either end of the upper portion of the body of the flap. The pockets are adapted for folding engagement to the interior of the upturned inner band on opposite sides of the interior of the cap. The body of the flap depends from the back of the hat protecting the back of a wearer's neck and ears from harmful sunlight waves. A problem arises when the wearer removes his cap. The reinforced pockets have a tendency to loosen and fall out of the upturned inner band when the cap is removed or jostled about.

U.S. Pat. No. 5,081,717 discloses a similar accessory to headgear which provides protection of the posterior neck region, both ears and a portion of either side of the face. The accessory comprises a conformable member that may be manually bent to impart a self-sustaining shape to conform to the wearer's head and spring-loaded binder clips which are used as attachment means to the hat. The attachment tends to be cumbersome and the clips tend to be uncomfortable to the wearer.

The invention disclosed herein overcomes the undesirable features of prior art by providing a new and improved protective headgear attachment for baseball style hats having flexible and secure engagement means that can be easily attached and detached.

SUMMARY OF THE INVENTION

The present invention is directed to a detachable protective headgear attachment for engagement to a hat having an upturned inner band. The headgear attachment comprises engagement clips, preferably being substantially rectangular having upper and lower portions, and upper and lower tabs, wherein the upper tab extends from the upper portion and the lower tab extends from the lower portion, the upper and lower tabs being opposingly situated. The headgear attachment further comprises a substantially rectangular flexible protective shield comprising an upper and lower portion, wherein the engagement clips are attached to the upper portion of the flexible shield, and wherein the flexible shield depends from the engagement clips. The headgear attachment is fastened to a baseball style hat by engaging the engagement clips to the upturned inner band at opposite sides of the hat, the upper tab being disposed between the upturned inner band and the interior crown portion and the lower tab being substantially flush with the exterior crown portion.

The present invention herein also discloses a clip having a variety of applications. The clip is preferably substantially rectangular having upper and lower portions, and upper and lower tabs, wherein the upper tab extends from the upper portion and the lower tab extends from the lower portion, the upper and lower tabs being opposingly situated.

The present invention provides a new and improved sunguard device for attachment to a baseball style hat of relatively simple and inexpensive design, construction and operation, which is safe, durable and machine washable, and which fulfills the intended purpose of reducing sunburn by protecting an individual's ears and the back of the wearer's neck during use without any adverse affects to the hat.

Other objects, features, and characteristics of the present invention, as well as the methods of operation and functions of the related elements of the structure, and the combination of parts and economics of manufacture, will become more apparent upon consideration of the following description with reference to the accompanying drawings, all of which form a part of this specification.

DETAILED DESCRIPTION INVENTION

Figure 1:
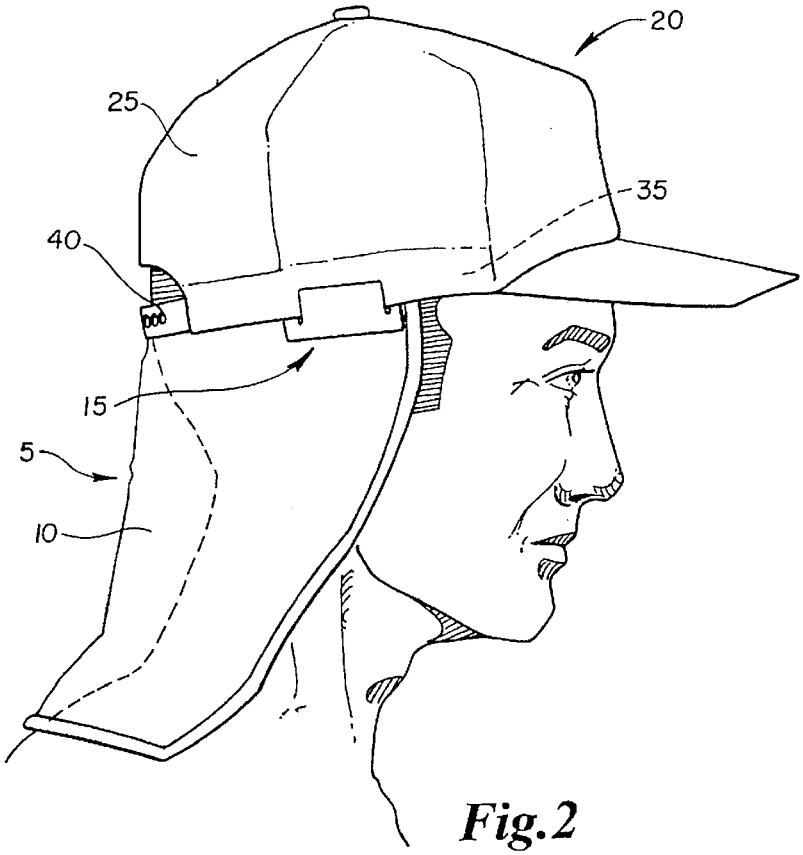
FIG. 1 is a side elevational view of the invention installed on a hat.

In FIG. 1 there is shown a side view of the present invention attached to a baseball style hat on a wearer. The protective headgear attachment, generally designated 5, basically comprises a flexible shield 10 and a plurality of flexible engagement clips, generally designated 15, connected to the upper portion 45 of the flexible shield 10. The protective headgear attachment 5 is preferably engaged to a hat, generally designated 20, having an exterior crown portion 25, an interior crown portion 30, an upturned inner band 35 and an expandable member 40, wherein the engagement clips are attached at positions which are on approximately opposite sides of the interior of the hat.

Figure 4:
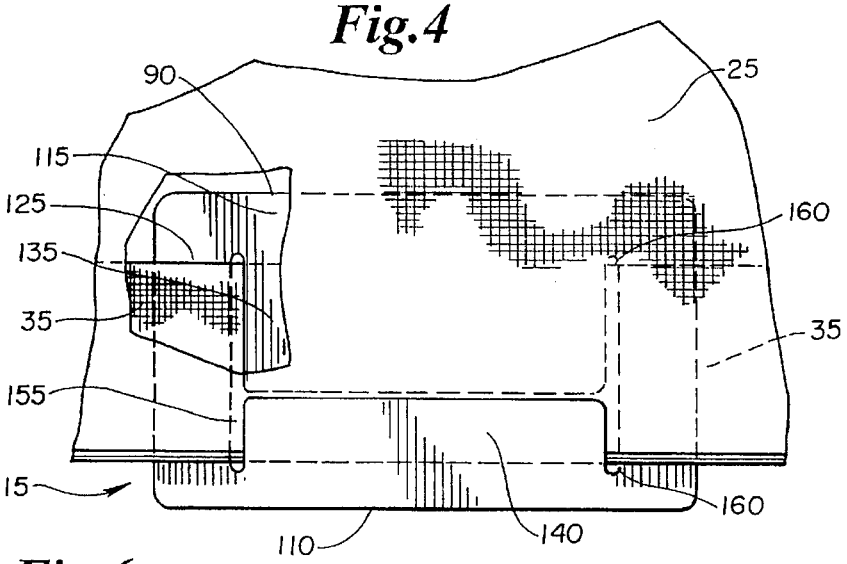
FIG. 4 is a top plan view of the clip thereof, installed on the hat, with portions cut away to show position of the upturned inner band and clip tabs.
Figure 6:
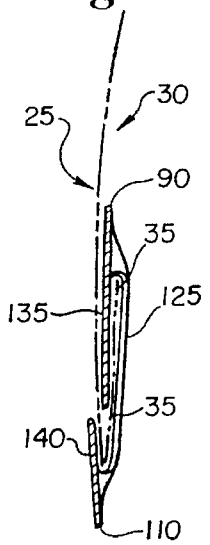
FIG. 6 is a sectional view of the clip thereof, taken along line 6—6 in FIG. 5.
Figure 5:
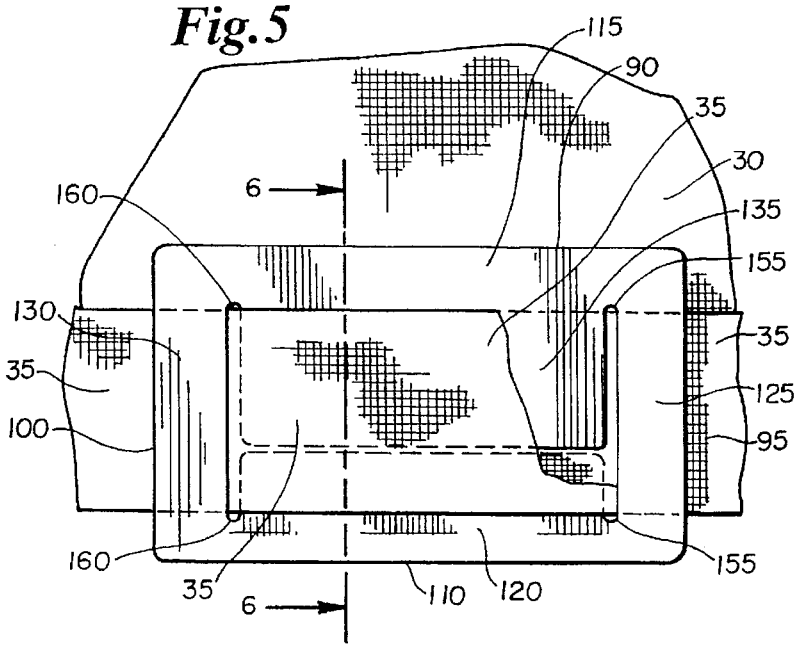
FIG. 5 is a bottom plan view of the clip thereof, installed on the hat, with portions cut away to show position of the upturned inner band and clip tabs.

Particular attention should be directed to the upturned inner band 35, which is shown in phantom lines in FIGS. 1 and 4, and is best shown in FIGS. 5 and 6. This upturned inner band 35 is common to baseball style hats and is well known in the art. The upturned inner band 35 is preferably folded upward within the interior crown portion 30 of the hat 20 in flush contact with the interior crown portion 30. Generally, the upturned inner band 35 is not affixed to the interior crown portion 30. The upturned inner band 35 is the point of engagement between the flexible engagement clips 15 and the hat 20, the arrangement of which is further detailed below. As seen in FIG. 1, the body of the protective headgear attachment 5 depends from the back of the hat 20, fastened with the flexible clips 15, which are partially exposed, and can be used for various advertising.

Figure 2:
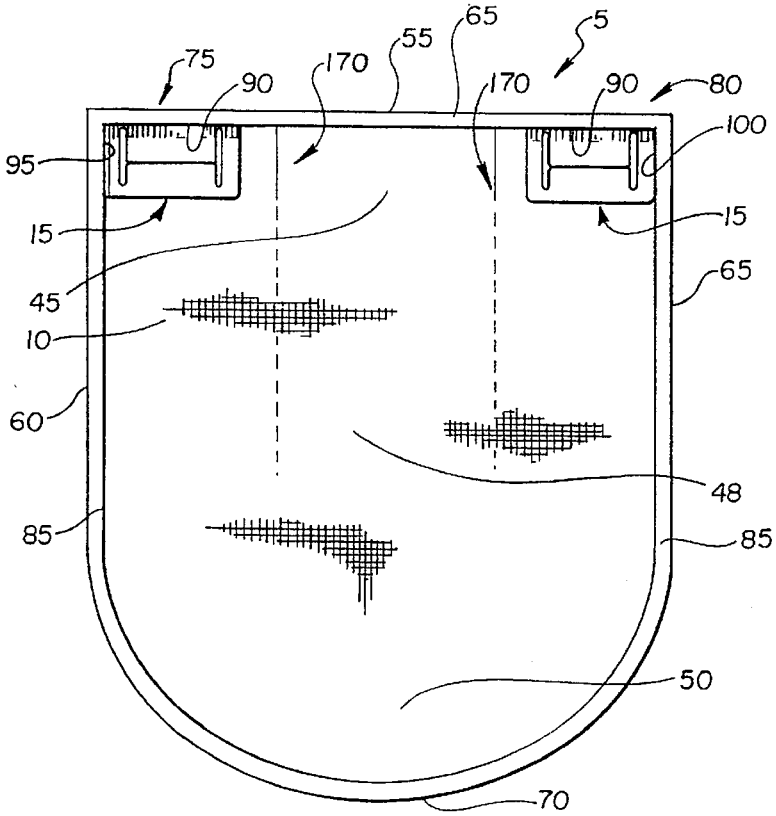
FIG. 2 is a top plan view of the invention.

The flexible shield 10 of the protective headgear attachment 5, as shown in FIG. 2, which shows the protective headgear attachment detached from the hat 20 and expanded to a flat configuration, is preferably substantially rectangular having an upper portion 45, a center portion 48 and a lower portion 50. The flexible shield 10 further comprises a first edge 55, a second edge 60, a third edge 65 and a fourth edge 70. The first 55 and second 60 edges define a first corner 75 and the first 55 and third 65 edges define a second corner 80. In the preferred embodiment the flexible shield 10 also includes a hem established around the periphery of the flexible shield 10. The fourth edge 70 is preferably rounded, but may be shaped in a variety of configurations. The flexible shield may be comprised of any flexible or pliable material, but preferably is comprised of light weight cloth or cotton fabric, leather or plastic. The material and dimensions of the protective headgear attachment 5 may be varied substantially at the preference of an individual, provided the essential features, functions and attributes described herein are not sacrificed.

The protective headgear attachment further comprises at least one flexible engagement clip 15, preferably two. The flexible engagement clips are preferably flexible and substantially rectangular, but may be made of rigid material in a variety of shapes as long as the basic nature of the clip is not compromised. In the preferred embodiment, two flexible engagement clips 15 are positioned and attached to the flexible shield 10 in the first corner 75 and the second corner 80, respectively. Preferably, each of the flexible engagement clips 15 is positioned and attached so that it substantially conforms with its respective corner.

Figure 3:
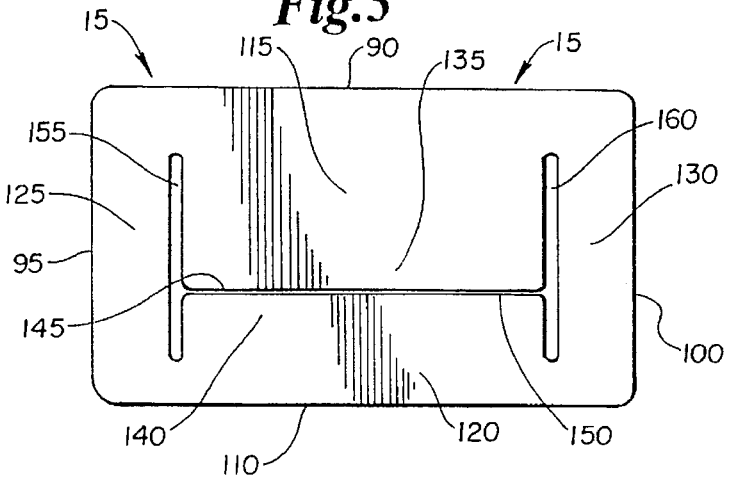
FIG. 3 is a top plan view of the clip thereof.

A clearer view of a flexible engagement clip 15 is shown in FIG. 3. The flexible engagement clip generally is a clip comprising first 90, second 95, third 100 and fourth 110 edges, an upper portion 115, a lower portion 120, a first side panel 125, a second side panel 130, an upper tab 135 extending downward forming a first free standing end, and a lower tab 140 extending downward forming a second free standing end. The flexible engagement clip 15 is generally flat, having a front and back side and preferably made of flexible resilient and durable material that retains its shape upon exposure to prolonged use such as plastic.

In the preferred embodiment, attachment of the flexible engagement clips 15, best seen in FIG. 2, is achieved by conforming the corner defined by the first 90 and second 95 edges of a first flexible engagement clip 15 to corner 75 of the flexible shield and stitching edges 90 and 95 within the hem of the corner 75. A second flexible engagement clip 15 is attached by stitching edges 90 and 100 of the second flexible engagement clip into the hem of corner 80 of the flexible shield. Preferably the stitching is of a double thickness of folded fabric material. Attachment of the flexible engagement clips to the flexible shield may be accomplished by other means variations, such as staples, stitches and the like, as long as the flexible shield is securely attached to the flexible engagement clips 15 and tabs 135 and 140 remain free to engage the hat 20.

The flexible engagement clip 15 (FIG. 3) further comprises a upper tab edge 145 and a lower tab edge 150. The upper tab 135 extends from the upper portion 115 downward between side panels 125 and 130 toward the lower portion 120 terminating with a substantially flat edge, which defines the upper tab edge 145. The lower tab 140 extends from the lower portion 120 upward between side panels 125 and 130 toward the upper portion 115 terminating with a substantially flat edge, which defines the lower tab edge 150. In the preferred embodiment, the upper tab edge 145 and the lower tab edge 150 abut each other in close proximity, separated by a slight gap. Tabs 135 and 140 are flexible and may be bent through the plane established by side panels 125 and 130. Preferably, the upper tab 135 is larger than the lower tab 140 for easier engagement within the upturned inner band 35 of a hat 20. It is also preferable that the flexible engagement clip comprise a first elongated gap 155 between tabs 135 and 140 and the first side panel 125 and a second elongated gap 160 between tabs 135 and 140 and the second side panel 130. These elongated gaps aid in engagement of the flexible engagement clips 15 and the upturned inner band 35 and allow for free movement of tabs 135 and 140.

One method in which the clip body may be manufactured is by making cuts in a substantially planar body, preferably plastic, defining tabs 135 and 140. One cut is made in forming the upper tab 135 defining the three sides of the upper tab 135 and another cut is made forming the lower tab 140 defining the three sides of the lower tab 140. It should be understood that other methods of cutting out the upper and lower tabs may be employed. In the resulting clip, the upper tab 135 and the lower tab 140 are flexibly attached to the planar clip body by the upper portion 115 and the lower portion 120, respectively.

FIGS. 4–6 illustrate proper engagement of the protective headgear attachment 5 to a hat 20. For simplicity sake FIGS. 4–6 do not include the flexible shield 10. The arrangement of the flexible shield will become clear in the discussion of the proper engagement.

FIG. 4 represents a view of the lower portion of the exterior crown portion 25 and the engagement of a flexible engagement clip 15 thereon. As seen in FIG. 1, from the outside of the cap 20 with the protective headgear attachment 5 engaged thereto only the fourth edge 110, the lower portion 120 and the lower tab 140 of the flexible engagement clip 15 are visible. The cut-out portion and the phantom lines of FIG. 4 more clearly illustrate the engagement of the flexible engagement clip 15. The cut-out portion reveals the upturned inner band 35 overlapping first side panel 125 and entering, from left to right, first elongated gap 155 and proceeding behind upper tab 135, which is disposed between the upturned inner band 35 and the interior crown portion 30. Situated between elongated gaps 155 and 160, the upper tab 135 is sandwiched between the upturned inner band 35 and the interior crown portion 30 and the lower tab 140 extends upward over the outside of the exterior crown portion 25. The upturned inner band 35 exits through elongated gap 160 overlapping second side panel 130. The flexible engagement clip 15 is firmly secured in place eliminating any chance of unintentional detachment.

FIG. 5 represents a view of the lower portion of the interior crown portion 30 and the engagement of a flexible engagement clip 15 thereon. FIG. 5 is the opposite view of that shown in FIG. 4. From this view only the upturned inner band 35, side panels 125 and 130, upper and lower portions 115 and 120 and edges 90, 95, 100 and 110 are visible. The cut-out portion and the phantom lines of FIG. 5 aid in the illustrate of the engagement of the flexible engagement clip 15. The cut-out portion reveals the first side panel 125 overlapping upturned inner band 35 as upturned inner band 35 enters, from right to left, first elongated gap 155 and visibly proceeds over the back side of tabs 135 and 140. Tab 135 is disposed between the upturned inner band 35 and the interior crown portion 30 and tab 140, shown in phantom lines, extends upward over the outside of the exterior crown portion 25. Situated between elongated gaps 155 and 160, the upper tab 135 is sandwiched between the upturned inner band 35 and the interior crown portion 30 and the lower tab 140, seen in phantom lines, extends upward over the outside of the exterior crown portion 25. The upturned inner band 35 overlaps tabs 135 and 140 proceeding, right to left, through elongated gap 160 and under the overlapping second side panel 130. The flexible engagement clip 15 is firmly secured in place eliminating any chance of unintentional detachment.

FIG. 6 is a sectional view of the engagement of flexible engagement clip 15 and upturned inner band 35, taken along line 6—6 in FIG. 5. FIG. 6 clearly illustrates the engagement of the flexible engagement clip 15 to upturned inner band 35. Engagement is accomplished by inserting upper tab 135 into the fold created by upturned inner band 35 so that upper tab 135 is situated between upturned inner band 35 and the lower interior crown portion 30. Lower tab 140 is then pulled under the bottom edge of upturned inner band 35 and outward toward the exterior of the hat 20 extending upward over the outside of the exterior crown portion 25. In the final engagement edge 90 points upward along interior crown portion 30, side panels 125 and 130 (130 not shown) are urged flush against the interior side of upturned inner band 35 and edge 110 points downward from the bottom edge of upturned inner band 35. The flexible shield, not shown in FIGS. 4–6, being attached to the flexible engagement clips 15 as described in FIG. 2 above, would depend from the back side of the flexible engagement clips 15 originating from the inside of the hat 20. In such an engagement, the upper and lower tabs cooperate in their engagement so that the clips resist movement up or down, thus preventing the protective headgear attachment 5 from being unintentionally released from the hat 20 during removal from the wearer's head or when the hat is jostled about.

The first edge 55 of the flexible shield may be fitted to the wearer's head by sliding the flexible engagement clips 15 along the upturned inner band 35 to create a snug fit. If first edge 55 is to long for the wearer's head or hat, first edge 55 may be folded over to take up the excess slack. In a preferred embodiment, at least one pleat 170, is incorporated in the flexible shield depending downward from first edge 55. Most preferably two pleats 170 are incorporated, one just inside each of the attached flexible engagement clip's 15. Such pleats 170 aid in preventing the flexible shield from being bunched or hung up on the wearer's collar by urging the body of the flexible shield outward away from the wearer's neck.

The center portion 48 of the flexible shield provides a visible surface for placement of logos, advertisement or other like displays. The lower portion 120 and the lower tab 140 of the flexible engagement clip 15 also provide a visible surface for similar displays.

It should be understood that the protective headgear attachment may also be used with other types of headgear that have suitable construction to which the engagement clips may be attached, such hats may include construction hats and batting hat. These type of hats include an internal adjustable band which may receive the engagement clips.

It should also be understood that the engagement clips may be used in other applications functioning only as a clip or a display clip. Such applications may include size and price displays attached to the inner band of hats in retail stores.

The above disclosure is intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. A detachable protective headgear attachment for engagement to a hat having an upturned inner band, comprising:

at least one engagement clip, the at least one engagement clip comprising back and front sides, upper and lower portions, and upper and lower tabs, wherein the upper tab extends downward from the upper portion to define a first free stranding end for placement behind the inner band of the hat and the lower tab extends upward from the lower portion to define a second free standing end for placement exterior of the hat, the free standing ends of the upper and lower tabs being opposingly situated so as to extend from their respective portions toward one another and at least one free standing end being capable of individual reciprocating movement between the upper and lower portions independent to the other free standing end; and a flexible shield comprising front and back sides and upper and lower portions, wherein the upper portion of the front side of the flexible shield is attached to the back side of the at least one engagement clip, the flexible shield depending therefrom.

2. A detachable protective headgear attachment for engagement to a hat having an upturned inner band, comprising:

first and second engagement clips, each engagement clip comprising back and front sides, upper and lower portions, and upper and lower tabs, wherein the upper tab extends from the upper portion for placement behind the inner band of the hat and the lower tab extends from the lower portion for placement exterior of the hat, the upper and lower tabs being opposingly situated; and a flexible shield comprising front and back sides and upper and lower portions, wherein the upper portion of the front side of the flexible shield is attached to the back side of each engagement clip, the flexible shield depending therefrom.

3. A detachable protective headgear attachment as in claim 2, the engagement clips being substantially rectangular.

4. A detachable protective headgear attachment as in claim 3, the flexible shield being substantially rectangular and further comprising first, second and third edges, whereon the front side of the flexible shield the first and second edges define a first corner and the first and third edges define a second corner, wherein the first engagement clip is attached to the flexible shield in close proximity to the first corner of the flexible shield and the second engagement clip is attached to the flexible shield in close proximity to the second corner of the flexible shield.

5. A detachable protective headgear attachment as in claim 4, the first and second engagement clips each further comprising first, second and third edges, wherein the first and second edges of the first engagement clip are substantially linearly aligned with the first and second edges of the first corner of the flexible shield, respectively and the first and third edges of the second engagement clip are substantially linearly aligned with the first and third edges of the second corner of the flexible shield, respectively.

6. A detachable protective headgear attachment as in claim 5, the upper tab being larger than the lower tab and wherein the first and second engagement clips are stitched to the flexible shield and are made of flexibly resilient and durable material.

7. A detachable protective headgear attachment as in claim 6, each engagement clip further comprising first and second side panels, the second and third edges of each engagement clip being defined thereby, respectively, the first edge of each engagement clip being defined by the upper portion of engagement clip, wherein the upper portion and the first panel of the first engagement clip are stitched to the flexible shield and are substantially flush with the first and second edges of the first corner of the flexible shield, respectively, and wherein the upper portion and the second panel of the second engagement clip are stitched to the flexible shield and are substantially flush with the first and third edges of the second corner of the flexible shield, respectively.

8. A detachable protective headgear attachment as in claim 7, wherein each engagement clip further comprises an upper tab edge and a lower tab edge, the upper tab edge and the lower tab edge both being substantially linear, wherein the upper tab edge is substantially flush with the lower tab edge.

9. A detachable protective headgear attachment as in claim 8, wherein each engagement clip further comprises a first elongated gap positioned between the first side panel and the upper and lower tabs, the first elongated gap being linearly aligned with the first side panel, and a second elongated gap positioned between the second side panel and the upper and lower tabs, the second elongated gap being linearly aligned with the second side panel.

10. A detachable protective headgear attachment as in claim 9, the flexible shield further comprising a hem oriented along the periphery thereof, wherein the engagement clips are stitched within the hem.

11. A detachable protective headgear attachment as in claim 10, the flexible shield being made of a material chosen from a group comprising cotton, plastic and leather and the engagement clips being made of plastic.

12. A detachable protective headgear attachment as in claim 11, the flexible shield further comprising at least one pleat, the at least one pleat depending from the first edge of the flexible shield.

13. A detachable protective headgear attachment as in claim 12, the flexible shield further comprising a fourth edge, the fourth edge being rounded.

14. An engagement clip for use, among other things, in a detachable protective headgear attachment for engagement to a hat having an upturned inner band, comprising back and front sides, upper and lower portions, and upper and lower tabs, wherein the upper tab extends from the upper portion to define a first free standing end and the lower tab extends from the lower portion to define a second free standing end, the free standing ends of the upper and lower tabs being opposingly situated so as to extend from their respective portions toward one another and at least one free standing end being capable of individual reciprocating movement between the upper and lower portions independent to the other free standing end, the engagement clip being substantially rectangular having first, second, third and fourth edges and the upper tab being larger than the lower tab.

15. An engagement clip as in claim 14, the engagement clip further comprising first and second side panels, the second and third edges of the engagement clip being defined thereby, respectively, and the first edge of the engagement clip being defined by the upper portion of the engagement clip.

16. An engagement dip for use, among other things, in a detachable protective headgear attachment for engagement to a hat having an upturned inner band, comprising back and front sides, upper and lower portions, and upper and lower tabs, wherein the upper tab extends from the upper portion and the lower tab extends from the lower portion, the upper and lower tabs being opposingly situated, the engagement clip being substantially rectangular having first, second, third and fourth edges and the upper tab being larger than the lower tab, the engagement clip further comprising first and second side panels, the second and third edges of the engagement clip being defined thereby, respectively, and the first edge of the engagement clip being defined by the upper portion of the engagement clip, wherein the engagement clip further comprises an upper tab edge and a lower tab edge, the upper tab edge and the lower tab edge both being substantially linear, wherein the upper tab edge is substantially flush with the lower tab edge.

17. An engagement clip as in claim 16, wherein the engagement clip further comprises a first elongated gap positioned between the first side panel and the upper and lower tabs, the first elongated gap being linearly aligned with the first side panel, and a second elongated gap positioned between the second side panel and the upper and lower tabs, the second elongated gap being linearly aligned with the second side panel.

18. A hat with a detachable protective headgear attachment, comprising:

a hat comprising an upturned inner band, an exterior crown portion, and an interior crown portion;

first and second engagement clips, each engagement clip comprising back and front sides, upper and lower portions, and upper and lower tabs, wherein the upper tab extends from the upper portion and the lower tab extends from the lower portion, the upper and lower tabs being opposingly situated; and a flexible shield, the flexible shield being substantially rectangular and comprising front and back sides and upper and lower portions, wherein the upper portion of the front side of the flexible shield is attached to the back side of each engagement clips, the flexible shield depending therefrom;

wherein the first and second engagement clips are engaged to the upturned inner band at opposite sides of the hat, the upper tab being disposed between the upturned inner band and the interior crown portion and the lower tab being substantially flush with the exterior crown portion.

19. A hat with a detachable protective headgear attachment as in claim 18, the engagement clips being substantially rectangular.

20. A detachable protective headgear attachment as in claim 19, the flexible shield further comprising first, second and third edges, whereon the front side of the flexible shield the first and second edges define a first corner and the first and third edges define a second corner, and the first and second engagement clips each further comprising first, second and third edges, wherein the first engagement clip is attached to the flexible shield in close proximity to the first corner of the flexible shield and the second engagement clip is attached to the flexible shield in close proximity to the second corner of the flexible shield, the first and second edges of the first engagement clip being substantially linearly aligned with the first and second edges of the first corner of the flexible shield, respectively and the first and third edges of the second engagement clip being substantially linearly aligned with the first and third edges of the second corner of the flexible shield, respectively.

21. An engagement clip for use, among other things, in a detachable protective headgear attachment for engagement to a hat having an upturned inner band, the engagement clip comprising back and front sides, upper and lower portions, the upper portion having a lower part and the lower portion having an upper part, first and second flexible side portions and upper and lower tabs, wherein the upper tab extends downward from the lower part of the upper portion to define a first free standing end, the first free standing end having a substantially linear edge facing the lower tab and lower portion and being substantially perpendicular to the direction of the extension of the upper tab from the upper portion, and the lower tab extends from the upper part of the lower portion to define a second free standing end, the free standing ends of the upper and lower tabs being opposingly situated so as to extend from their respective portions toward one another and at least one free standing end being capable of individual reciprocating movement between the upper and lower portions independent to the other free standing end, wherein the engagement clip has a substantially uniform thickness, whereby the engagement clip is deformable for the engagement to the inner band of the hat.

22. An engagement clip for use, among other things, in a detachable protective headgear attachment for engagement to a hat having an upturned inner band, the engagement clip comprising back and front sides, upper and lower portions having opposing upper and lower edges, respectively, first and second deformable side portions and upper and lower tabs, wherein the upper tab and the lower tab internally extend inwardly toward one another from the upper and lower portions, respectively, so that the upper and lower tabs are opposingly situated and at least one tab being capable of individual inward reciprocating movement, the upper tab further having a substantially linear edge facing the lower tab and the lower edge of the lower portion and being substantially perpendicular to the direction of the extension of the upper tab from the upper portion, wherein the engagement clip has a substantially uniform thickness, whereby the engagement clip is deformable for the engagement to the inner band of the hat.

23. A detachable protective headgear attachment for engagement to a hat having an upturned inner band, comprising:

at least one engagement clip, the at least one engagement clip comprising back and front sides, upper and lower portions, the upper portion having a lower part and the lower portion having an upper part, and upper and lower tabs, wherein the upper tab extends from the lower part of the upper portion to define a first free standing end for placement behind the inner band of the hat and the lower tab extends from the upper part of the lower portion to define a second free standing end for placement exterior of the hat, the free standing ends of the upper and lower tabs being opposingly situated so as to extend from their respective parts toward one another and at least one free standing end being capable of individual reciprocating movement between the upper and lower portions independent to the other free standing end; and a flexible shield comprising front and back sides and upper and lower portions, wherein the upper portion of the front side of the flexible shield is attached to the back side of the at least one engagement clip, the flexible shield depending therefrom.

24. An engagement clip for use, among other things, in a detachable protective headgear attachment for engagement to a hat having an upturned inner band, comprising back and front sides, upper and lower portions, the upper and lower portions having parallel outer linear edges, two flexible side portions and upper and lower tabs, wherein the upper tab extends from the upper portion to define a first free standing end and the lower tab extends from the lower portion to define a second free standing end, the free standing ends of the upper and lower tabs being opposingly situated so as to extend from their respective portions toward one another and at least one free standing end being capable of individual reciprocating movement between the upper and lower portions independent of the other free standing end.

* * * * *